United States Patent [19]

Gir et al.

[11] Patent Number: 4,629,554

[45] Date of Patent: Dec. 16, 1986

[54] COAL LIQUEFACTION WITH COAL TAR SOLVENT

[75] Inventors: Srikant Gir, Memphis, Tenn.; Donald E. Rhodes, Oklahoma City, Okla.

[73] Assignee: Kerr-McGee Corporation, Oklahoma City, Okla.

[21] Appl. No.: 777,549

[22] Filed: Sep. 19, 1985

[51] Int. Cl.[4] ..... C10G 1/00; C10G 1/06

[52] U.S. Cl. ..... 208/415; 208/416; 208/418; 208/419

[58] Field of Search ..... 208/10, 8 LE, 415, 416, 208/418

[56] References Cited

U.S. PATENT DOCUMENTS

| | | | |
|---|---|---|---|
| 3,607,716 | 9/1971 | Roach | 208/8 |
| 3,607,717 | 9/1971 | Roach | 208/8 LE |
| 3,607,718 | 9/1971 | Leaders et al. | 208/8 |
| 3,966,585 | 6/1976 | Gray et al. | 208/8 LE |
| 4,036,731 | 7/1977 | Geoffrey | 208/8 LE |
| 4,082,644 | 4/1978 | Gatsis | 208/8 LE |
| 4,101,416 | 7/1978 | Dolbear | 208/8 LE |
| 4,119,523 | 10/1978 | Baldwin et al. | 208/8 LE X |
| 4,133,646 | 1/1979 | Farcasiu et al. | 208/8 LE X |
| 4,162,958 | 7/1979 | Baldwin | 208/8 LE |
| 4,189,372 | 2/1980 | Baldwin et al. | 208/8 |
| 4,312,746 | 1/1982 | Tsai et al. | 208/8 LE |
| 4,334,977 | 6/1982 | Derbyshire et al. | 208/8 LE |
| 4,357,228 | 11/1982 | Che | 208/8 LE |
| 4,415,429 | 11/1983 | Stadelhofer et al. | 208/8 LE |
| 4,511,460 | 4/1985 | Baument et al. | 208/8 LE |

*Primary Examiner*—Andrew H. Metz
*Assistant Examiner*—William G. Wright
*Attorney, Agent, or Firm*—William G. Addison

[57] ABSTRACT

A method of liquefying coal in which coal is mixed with a process solvent comprising at least partially hydrogenated coal tar material to produce a coal-solvent slurry. This slurry is treated under coal-liquefying conditions, preferably including a hydrogen atmosphere and elevated temperatures, to produce a solution containing coal liquefaction products. These products are recovered from the solution. Recovered, process-derived solvent material may be recycled in order to supplement the at least partially hydrogenated coal tar material as an ingredient of the process solvent.

15 Claims, 1 Drawing Figure

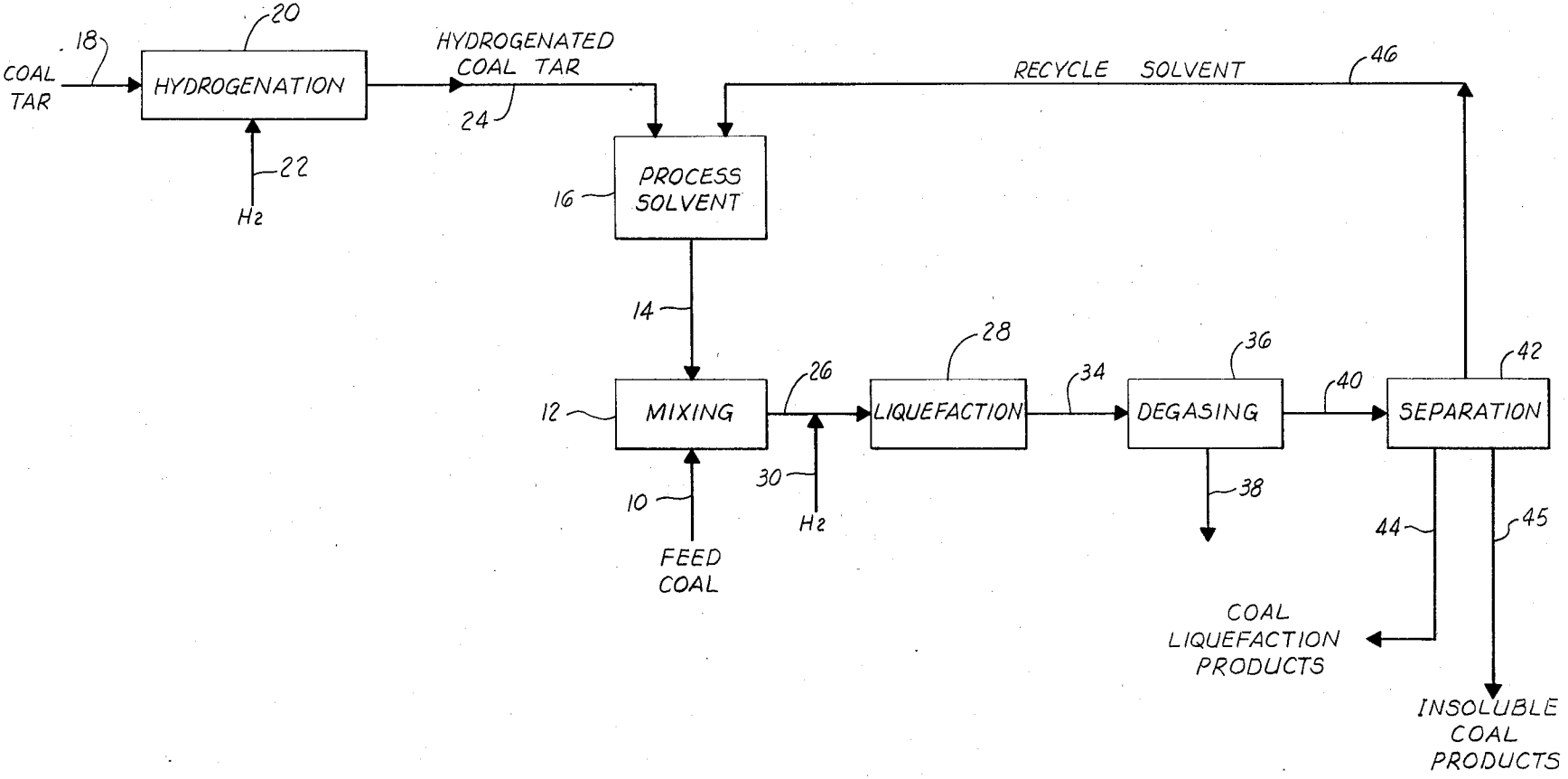
COAL TAR
18
HYDROGENATION
20
22
H2
HYDROGENATED COAL TAR
24
PROCESS SOLVENT
16
RECYCLE SOLVENT
46
14
MIXING
12
10
FEED COAL
26
30
H2
LIQUEFACTION
28
34
DEGASING
36
38
40
SEPARATION
42
44
45
COAL LIQUEFACTION PRODUCTS
INSOLUBLE COAL PRODUCTS

COAL LIQUEFACTION WITH COAL TAR SOLVENT

FIELD OF THE INVENTION

The present invention relates generally to methods for liquefaction of coal, and more particularly to such methods using coal tar material as a process solvent.

SUMMARY OF THE INVENTION

The present invention comprises a method of liquefying coal in which coal is mixed with a process solvent comprising at least partially hydrogenated coal tar material to produce a coal-solvent slurry. This slurry is treated under coal-liquefying conditions to produce a solution containing coal liquefaction products. These products then are recovered from the solution.

BRIEF DESCRIPTION OF THE DRAWING

The FIGURE is a schematic view showing the flow of materials in the coal liquefaction method of the present invention.

DETAIL DESCRIPTION OF THE PREFERRED EMBODIMENTS

With reference to the FIGURE, the method of the present invention is performed by transferring raw coal, via conduit 10, into a mixing zone 12, which preferably comprises a mixer equipped with a motor-driven agitator. In the mixing zone 12 the coal is mixed with a process solvent, which preferably is received via a conduit 14 from a surge vessel 16. The process solvent is mixed with the coal, most preferably in a coal/solvent weight ratio of between about 0.4 and about 0.7, to produce a coal-solvent slurry.

The coal used in the method of the present invention preferably is of a rank lower than anthracite, such as subanthracite, bituminous, subbituminous, lignite, brown coal, or peat. The particle size of the coal may vary over wide ranges and in general the particles need be only sufficiently small to be slurried in the process solvent and pumped. For instance, the coal may have an average particle size of one-fourth inch in diameter or larger in some instances, and as small as minus 200 mesh (Tyler Screen) or smaller. The most practical particle size is often between minus 30 mesh and minus 100 mesh, as less energy is required for grinding this size of the particles, which are sufficiently small to achieve an optimum rate of solubilization. The particle size of the coal is not of great importance as long as extremely large particles are not present.

The process solvent used in the method of the present invention preferably comprises coal tar material, a substance that contains hydrogen donor compounds that are effective solvents for coal. The coal-dissolving capacity of the coal tar material preferably is enhanced, and its hydroaromatic content increased, by at least partially hydrogenating the coal tar material before it is used in the method of the present invention. In one embodiment of the present invention at least partially hydrogenated coal tar material is prepared by introducing coal tar material, by way of a conduit 18, into a hydrogenation zone 20, where the coal tar material is hydrogenated with molecular hydrogen introduced via conduit 22. After the hydrogenation step is completed, at least partially hydrogenated coal tar material is withdrawn from the hydrogenation zone 20 via conduit 24.

The coal tar material used in the method of the present invention may comprise either unfractionated coal tar or one or more coal tar fractions. Preferred coal tar fractions are those which contain compounds, such as pyrene, anthracene, quinoline, carbazole and 5,6-benzoquinoline, which function as effective hydrogen donors after partial hydrogenation. Particularly preferred coal tar fractions for use in practice of the present invention are the heavy oil and anthracene oil fractions.

The hydrogenation zone 20 preferably is maintained under conditions which selectively at least partially hydrogenate aromatic compounds in the coal tar material to hydroaromatics. When the coal tar material contains polycyclic aromatic compounds, it is preferred that at least one condensed aromatic ring in each polycyclic be retained after the hydrogenation step is completed. Because organonitrogen compounds function as effective hydrogen donors in coal solubilization, it is particularly preferred that the hydrogenation conditions minimize the number of carbon-nitrogen bonds that are broken in the treated coal tar material, and that these conditions substantially preserve the integrity of organonitrogen coal tar components.

The amount of hydrogen that is introduced into the hydrogenation zone 20 shoiuld be sufficient to hydrogenate the coal tar material to the extent described above, but insufficient to cause further hydrogenation of the coal tar material. The hydrogen partial pressure in the hydrogenation zone 20 is preferably between about 1000 p.s.i.g. and about 3000 p.s.i.g. The temperature of the hydrogenation zone 20 preferably is maintained at between about 500° F. and about 800° F., and the coal tar material preferably is retained in the hydrogenation zone 20 for between about 30 minutes and about 120 minutes. The hydrogenation reaction may be promoted by introducing a hydrogenation catalyst, such as a mixed nickel-molybdenum catalyst, into the hydrogenation zone 20. After the hydrogenation step has been completed, at least partially hydrogenated coal tar material from hydrogenation zone 20 is transferred, via conduit 24, to the surge vessel 16, where the material is available for use as a process solvent in the method of the present invention.

The coal-solvent slurry prepared in the mixing zone 12 is transferred, via conduit 26, to a liquefaction zone 28, where the slurry is treated under coal-liquefying conditions. In the liquefaction zone 28, hydrogen donor compounds in the process solvent, such as at least partially hydrogenated coal tar material described above, solvate the coal in the slurry to produce a solution containing soluble coal liquefaction products and insoluble coal products, such as fusain and mineral matter, in admixture with the process solvent.

Because solubilization of coal is promoted by the presence of an at least partial hydrogen atmosphere in the liquefaction zone 28, molecular hydrogen preferably is introduced into the coal-solvent slurry via a conduit 30. The amount of hydrogen introduced into the slurry is preferably between about 3% and about 10% by weight of the amount of coal in the slurry. Although the presence of hydrogen is preferred, it should be understood that molecular hydrogen is not absolutely necessary for practice of the method of the present invention.

The liquefaction zone 28, which preferably comprises a reactor vessel, preferably is maintained at a superatmospheric pressure determined by the amount of molecular hydrogen present in the coal-solvent slurry to be treated. Preferred pressures are between about 700 p.s.i.g. and about 3000 p.s.i.g. The liquefaction zone 28 and its contents preferably are maintained at a temperature of between about 500° F. and about 900° F., and the coal-solvent slurry preferably is retained in the liquefaction zone 28 for between about 5 minutes and about 60 minutes. In the event that molecular hydrogen is introduced into the coal-solvent slurry, a hydrogenation catalyst, such as a mixed nickel-molybdenum catalyst, may be provided in the liquefaction zone 28 in order to promote the liquefaction of coal products.

After the liquefaction step is complete, the solution containing coal liquefaction products and insoluble coal products is transferred, via conduit 34, to a degasing zone 36, in which the pressure on the solution is reduced. Unreacted molecular hydrogen and gaseous products of the liquefaction step are separated from the solution and withdrawn from the degasing zone via conduit 38. After any necessary purification, molecular hydrogen withdrawn through conduit 38 may be recycled for use in one or both of the hydrogenation steps of the method of the present invention.

The solution containing coal liquefaction products and insoluble coal products next is transferred by conduit 40 to a separation zone 42, where coal liquefaction products are recovered from the solution. The separation zone 42, which is shown schematically in the Figure, may comprise equipment for performing atmospheric or vacuum distillation procedures, critical solvent deashing procedures such as those described in U.S. Pat. No. 3,607,716, a combination of such procedures, or any alternative separation procedure. The coal liquefaction products produced in the recovery step are withdrawn from the separation zone 42 via one or more conduits, shown schematically by line 44 in the Figure. In many instances, these coal liquefaction products will be further fractionated after the initial recovery step. Insoluble coal products also are separated from the solution in the separation zone 42, and are withdrawn via conduit 45.

In many instances, optimal practice of the method of the present invention will require the at least partially hydrogenated coal tar material to be supplemented by a process-derived solvent material, so that the process solvent comprises a mixture of the at least partially hydrogenated coal tar material and a process-derived, recycled solvent material. In this event, it is preferred to recycle at least a portion of one of the recovered fractions of solution containing coal liquefaction products. A preferred function for use as a recycled solvent material is all or part of that fraction having a normal boiling point of between about 300° F. and about 1000° F.

Recycled, process-derived solvent material is transferred from the separation zone 42, via conduit 46, to the surge vessel 16, where the material is mixed with at least partially hydrogenated coal tar material to form the process solvent used in the method of the present invention. In another embodiment of the present invention, not shown in the Figure, recycled process-derived solvent material first may be treated in the hydrogenation zone 20 prior to undergoing reuse as a constituent of the process solvent. In a preferred embodiment, at least partially hydrogenated coal tar material comprises between about 10% and about 30% by weight of the process solvent.

In many instances, the coal liquefaction products which would ordinarily be recycled for use as a process-derived solvent have alternative end uses which make these products economically valuable. On the other hand, the coal tar material which is used, at least in part, as the process solvent in the method of the present invention is often a byproduct material having considerably less value than coal liquefaction products. By using less valuable coal tar derivatives in place of process-derived recycle material as a liquefaction solvent, the method of the present invention offers an improved yield of coal liquefaction products, and thus a more economically advantageous coal liquefaction method.

Changes may be made in the construction, operation and arrangement of the various parts, elements, steps and procedures described herein without departing from the spirit and scope of the invention as defined in the following claims.

What is claimed is:

1. A method of liquefying coal, comprising:

mixing solid coal with a process solvent comprising coal tar material which has been at least partially hydrogenated under conditions which selectively hydrogenate aromatic coal tar components to hydroaromatics and which preserve the integrity of organonitrogen coal tar components, to produce a coal-solvent slurry;

treating the coal-solvent slurry under coal-liquefying conditions in a liquefaction zone to produce a solution containing coal liquefaction products; and recovering coal liquefaction products from the solution.

2. The method of claim 1 in which the at least partial hydrogenation conditions comprise a pressure of between about 1000 p.s.i.g. and about 3000 p.s.i.g.

3. The method of claim 1 in which the at least partial hydrogenation conditions comprise a temperature of between about 500° F. and about 800° F.

4. The method of claim 1 in which the coal tar material is maintained under at least partial hydrogenation conditions for between about 30 minutes and about 120 minutes.

5. The method of claim 1 in which the liquefaction zone is characterized by at least a partial hydrogen atmosphere.

6. The method of claim 6 in which the hydrogen atmosphere is characterized by a partial pressure of between about 700 p.s.i.g. and about 3000 p.s.i.g.

7. The method of claim 1 in which the liquefaction zone is maintained at a temperature of between about 500° F. and about 900° F.

8. The method of claim 1 in which the coal-solvent slurry is retained in the liquefaction zone for between about 5 minutes and about 60 minutes.

9. The method of claim 1 further comprising:

separating process-derived material from the solution containing coal liquefaction products; and recycling at least a portion of the separated process-derived material to provide a component of the process solvent.

10. The method of claim 9 in which the process solvent comprises between about 10% and about 30% by weight of at least partially hydrogenated coal tar material.

11. The method of claim 9 in which the process-derived material is characterized by a normal boiling point of between about 300° F. and about 1000° F.

12. The method of claim 1 in which the coal tar material comprises unfractionated coal tar.

13. The method of claim 1 in which the coal tar material comprises at least one coal tar fraction.

14. The method of claim 9 in which the at least partially hydrogenated coal tar material comprising the process solvent is provided from a source external to the coal liquefaction method steps.

15. The method of claim 1 in which the at least partially hydrogenated coal tar material comprising the process solvent is provided from a source external to the coal liquefaction method steps.

* * * * *